US005751213A

United States Patent [19]

Åsbrink

[11] Patent Number: 5,751,213

[45] Date of Patent: May 12, 1998

[54] THEFT DETECTION ALARM ELEMENT FOR AVOIDING FALSE ALARMS

[76] Inventor: Leif Åsbrink, 01 3265, Jäders Prästgård, S-635 05 Eskilstuna, Sweden

[21] Appl. No.: 676,219

[22] PCT Filed: Feb. 2, 1995

[86] PCT No.: PCT/SE95/00100

§ 371 Date: Jul. 19, 1996

§ 102(e) Date: Jul. 19, 1996

[87] PCT Pub. No.: WO95/21431

PCT Pub. Date: Aug. 10, 1995

[30] Foreign Application Priority Data

Feb. 7, 1994 [SE] Sweden ..... 9400396

[51] Int. Cl.[6] ..... G06B 13/24

[52] U.S. Cl. ..... 340/572; 340/551; 340/825.54

[58] Field of Search ..... 340/572, 551, 340/825.54

[56] References Cited

U.S. PATENT DOCUMENTS

| | | | |
|---|---|---|---|
| 3,745,450 | 7/1973 | Wilt | 340/551 |
| 4,249,167 | 2/1981 | Purinton et al. | 340/572 |
| 4,333,072 | 6/1982 | Beigel | 340/572 |
| 4,476,459 | 10/1984 | Cooper et al. | 340/572 |
| 4,670,740 | 6/1987 | Herman et al. | 340/572 |
| 4,818,973 | 4/1989 | Yamakawa et al. | 340/572 |
| 5,021,765 | 6/1991 | Morgan | 340/572 |
| 5,171,228 | 12/1992 | McDonald | 604/175 |
| 5,241,298 | 8/1993 | Lian et al. | 340/572 |
| 5,559,507 | 9/1996 | Biegel | 340/572 |

FOREIGN PATENT DOCUMENTS 0469769 2/1992 European Pat. Off. .

*Primary Examiner*—Jeffery Hofsass
*Assistant Examiner*—Edward Lefkowitz
*Attorney, Agent, or Firm*—Alfred J. Mangels

[57] ABSTRACT

An alarm element forming part of an alarm system and constructed to receive a magnetic alternating field having the frequency F and transmitted by a transmitter (2). The alarm element retransmits a magnetic alternating field without an energy addition, this alternating field being received and detected by a receiver (3). The alarm element (1) has a circuit which includes a coil (L), a capacitance diode (D) and a resistor (R) in series in a closed circuit, and a capacitor (C) connected in parallel across the resistor (R). The coil (L) and the capacitance in the capacitance diode (D) form a resonance circuit having resonance at the frequency F when the voltage across the diode (D) is zero volts.

9 Claims, 1 Drawing Sheet

THEFT DETECTION ALARM ELEMENT FOR AVOIDING FALSE ALARMS

BACKGROUND OF THE INVENTION

1. Field of the Invention

The present invention relates to an alarm element which forms part of an alarm system.

2. Description of the Related Art

Such an alarm element is preferably used in goods-guarding systems, although it may also be used in other contexts in which goods or articles are provided with a marking which can be subsequently read-off electronically and used in one way or another.

Many different types of alarm systems for the protection or safeguarding of goods are described in the patent literature. These systems are intended to prevent goods from being taken from shops and stores without having been paid for, and will normally include some form of alarm element which is attached to the goods or articles to be protected, and a sensor arrangement which is installed permanently in the proximity of the store exit, this sensor arrangement generating an alarm with the aid of some form of remote sensing device when an alarm element is brought into the proximity of the store exit.

Remote sensing is normally effected by transmitting a magnetic alternating field, wherein the presence of an alarm element can be detected as a result of a change in the alternating field characteristic of the alarm element.

The alarm element may be a narrow, elongated and thin strip of highly permeable material whose characteristic feature resides in the transmission of high order harmonics when it is subjected to the effect of a magnetic alternating field. This known basic principle enables small and inexpensive alarm elements to be detected with the aid of complicated and relatively expensive sensing or detecting devices. This type of goods-protection or theft-prevention alarm is particularly suited for shops and stores which deal on a daily basis and is found described in European Patent Specification EP 0 153 286, among other publications.

Known alarm elements may also be comprised of a simple electric resonance circuit. In this case, a simple and inexpensive sensing device can be used when the coil in the resonance circuit is relatively large, thereby enabling a good Q-value to be readily obtained at the same time as connection with external fields is large. In this regard, the coil is included in an alarm plate or tag which is fastened to the goods to be protected, by means of some suitable looking device. As before mentioned, the sensing or detection devices for this type of alarm system may be relatively uncomplicated and inexpensive, although the problem of false alarms is difficult to avoid, since store environments often contain loops of electrically conductive material which give rise to resonances similar to those obtained from the alarm elements.

One method of avoiding false alarms is to give the alarm element the form of a frequency divider. U.S. Pat. No. Specification 4,670,740 describes an alarm element in the form of a frequency divider. Such a frequency divider can be readily constructed with solely one coil and one capacitance diode.

In this case, the magnetic field transmitted by a transmission coil must be relatively powerful, since the energy is absorbed in the alarm element at a frequency which is far from its resonance frequency. An inexpensive and simple alarm element of this kind therefore has a low degree of responsiveness or sensitivity.

European Patent Specification EP 0.469 769 defines a method of increasing responsiveness, or sensitivity, when two mutually connected magnetic resonance circuits are present. The one circuit receives a first magnetic field having a first frequency. The energy received is transferred to the other resonance circuit, which transmits a field having half the frequency. This thus also concerns a frequency divider. Even though responsiveness is increased in comparison with the use of only one resonance circuit, such an alarm element is both expensive and complicated.

SUMMARY OF THE INVENTION

The present invention relates to an alarm element which solves the aforesaid problems. The alarm element is of very simple and inexpensive construction and its signal can be readily detected and the sounding of false alarms can be easily avoided.

Thus, the present invention relates to an alarm element which forms part of an alarm system and which is constructed to receive a magnetic alternating field having the frequency F and transmitted by a transmitter, and which is also constructed to retransmit without the addition of energy a magnetic alternating field which is received and detected by a receiver. The inventive alarm element is characterized in that it has a circuit which includes a coil, a capacitance diode and a resistor connected in series in a closed circuit, and a capacitor which is connected in parallel across the resistor; and in that the coil and the capacitance in the capacitance diode form a resonance circuit having resonance at the frequency F when the voltage across the diode is zero volts.

BRIEF DESCRIPTION OF THE DRAWINGS

The invention will now be described in more detail partly with respect to an exemplifying embodiment of the invention illustrated in the accompanying drawing, in which.

DESCRIPTION OF THE PREFERRED EMBODIMENTS

Figure 1:
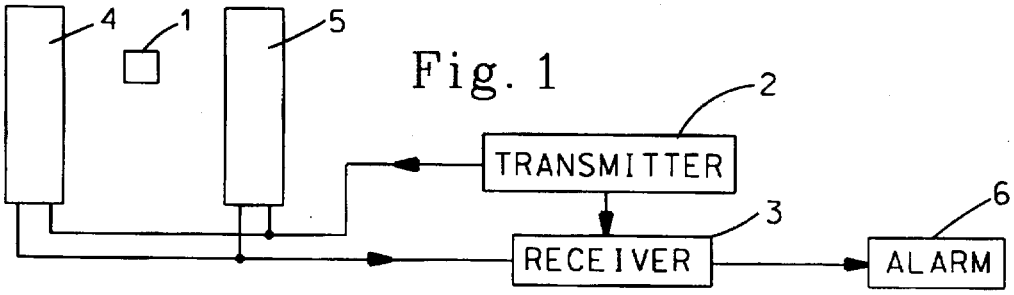
FIG. 1 is a block schematic illustrating a monitoring system.

FIG. 1 illustrates schematically a goods guarding or protecting system which includes an alarm element 1 which is constructed to receive a magnetic alternating field having the frequency F and transmitted from a transmitter 2, and which is also constructed to retransmit a magnetic alternating field without the addition of energy, this retransmitted field being received and detected by a receiver 3. The transmitter 2 is connected to transmission coils and the receiver 3 is connected to reception coils. The transmission and reception coils may be placed in one or more mutually spaced screens 4, 5 which delimit an investigation zone or detection zone through which people must pass when leaving the store. FIG. 1 shows an alarm element 1 located in the investigation zone. When the presence of an alarm element in the investigation zone is detected, the receiver 3 will send a signal to a suitable alarm indicating device 6, such as a light signal and/or an acoustic signal.

Goods-guarding systems of this kind are quite common today and are known in many different forms.

Figure 2:
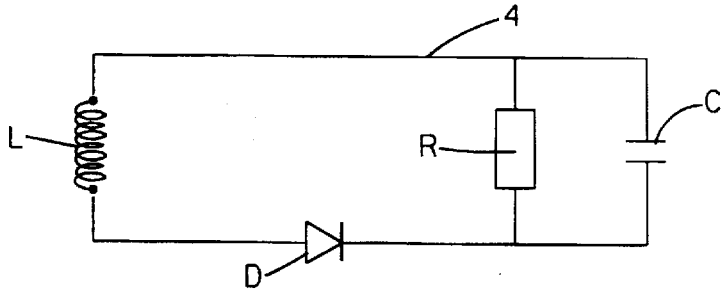
FIG. 2 is a circuit diagram illustrative of an alarm element.

The inventive alarm element has a circuit which includes a coil L, a capacitance diode D and a resistor R connected in series in a closed circuit, and a capacitor C which is connected in parallel across the resistor R, see FIG. 2. The coil L and the capacitance in the capacitance diode D form a resonance circuit having resonance at the frequency F, i.e. the frequency of the field transmitted by the transmitter 2, when the voltage across the diode D is zero volts.

According to one embodiment, the capacitance of the capacitor C is much larger than the capacitance of the capacitance diode D. As a result, the capacitor C will have an insignificant influence on the resonance frequency of the circuit coil and diode, while the alternating voltage across the resistor R is low.

The present invention is based on the understanding that there is obtained with such an alarm element a periodic variation in the total field in the investigation zone, which is received by the receiver coil or coils and the receiver 3. These periodic variations are detected in the receiver as changes in amplitude, in a suitable fashion.

In this way, there is obtained a system with which less powerful magnetic fields need be transmitted, by virtue of the fact that the alarm element has the same resonance frequency as the transmitted frequency. The alarm element also produces a signal which can be detected or sensed very easily. The alarm element is also inexpensive, any additional cost being caused solely by the two inexpensive components, the resistor R and the capacitor C, in comparison with a frequency divider of the kind defined in the introduction, for instance. Furthermore, because the alarm element gives rise to periodic variations, the occurrence of false alarms is highly unlikely since the shop or store in which the alarm element is used will not normally contain devices that generate periodic variations that could be received by the receiver and therewith understood as arriving from an alarm element.

Thus, the coil L together with the capacitance in the capacitance diode D forms a resonance circuit having resonance at a frequency F when the voltage across the capacitance diode D is zero volts. When the coil L is subjected to the effect of a magnetic alternating field at the resonance frequency F, an alternating voltage is built up across the capacitance diode D. In this regard, the time constant is determined by the bandwidth of the resonance circuit LD. When the voltage across the capacitance diode D reaches the forward voltage of the diode D, the diode begins to conduct and the capacitor C is charged. The resonance frequency is herewith displaced and the major part of the energy stored in the resonance circuit LD is converted to direct current, which is stored in the capacitor C. This process is very rapid. Once the capacitor C has been charged, the oscillation circuit is no longer in resonance and therefore has an insignificant alternating effect on the external field. In time, the duration of which depends on the resistor R and the capacitor C, the voltage across the capacitor C will be so low as to cause the resonance circuit LD to again absorb energy from the external field, and the process is repeated.

Thus, the alarm element behaves in the manner of an amplitude modulated transmitter whose carrier wave is synchronized with the signal transmitted by the detector arrangement. Both carrier waves and sideband are accommodated within the bandwidth of the resonance circuit, which means that the alarm element is effective both as a transmitter and as a receiver.

According to one preferred embodiment, the capacitance diode D has a high value of the derivative dC/dU at the zero crossing of the voltage. The higher the value of the derivative, the greater the change in the capacitance of the diode for a given change in voltage. This means that a high value of the derivative will permit weaker fields to be used and will produce a greater detectable change in amplitude of a transmitted field having a given strength. A capacitance diode suitable for this purpose is designated BB105.

According to one preferred embodiment, the resistance of the resistor R and the capacitance of the capacitor C are chosen so that the time constant for the discharge of the capacitor C will be 0.1 to 5 milliseconds.

For instance, when R=200 kOhm, C=1000 pF and F=8 MHz, the process will take about 0.5 milliseconds. The process is thus repeated at a frequency of 2 kHz.

A suitable frequency range for the frequency F is between 5 kHz and 10 GHz.

According to one preferred embodiment, in which the frequency F is between 1.5 MHz and 15 MHz, the transmitter 2 is constructed to transmit a frequency modulated field having the frequency F, where the modulation frequency is 20 to 200 Hz and with a frequency swing in order to reduce the necessary tolerance of the components of the alarm element, while reducing at the same time the risk of the responsiveness or sensitivity of the detection device of the receiver being reduced as a result of disturbances from powerful radio transmitters.

Preferably, the frequency swing at the aforesaid frequency range of the frequency F will not exceed +/− 2% but will be less than 10% of the frequency F, and that the frequency swing will preferably be +/− 5% of the frequency F.

In practice, it is suitable to allow the transmitter to be frequency modulated with a modulation frequency of 25 Hz for instance, and with a frequency swing of +/− 5% of the transmitter frequency.

According to one preferred embodiment of the invention, the transmitter is constructed to transmit only when the frequency F is rising in response to the modulation frequency, and will thus not transmit when the frequency is falling.

This affords the advantage that the energy stored in the alarm element is fully consumed before a frequency sweep starts again, which in turn means that the pulses transmitted by the alarm element will occur at specific times in relation to the modulation. This facilitates detection of the pulses.

According to another embodiment in which the frequency F lies in the range of 5 kHz 500 kHz, the modulation frequency is stochastic and has a frequency of up to about 10 kHz. However, the frequency swing and the modulation frequency shall be chosen so that the signal F transmitted by the transmitter, including sideband, will fall generally within the bandwidth of the resonance circuit. This will result in very effective disturbance suppression, particularly when using several alarm systems simultaneously. In this case, the frequency swing will have the same order of magnitude as the resonance bandwidth of the alarm element.

Figure 3:
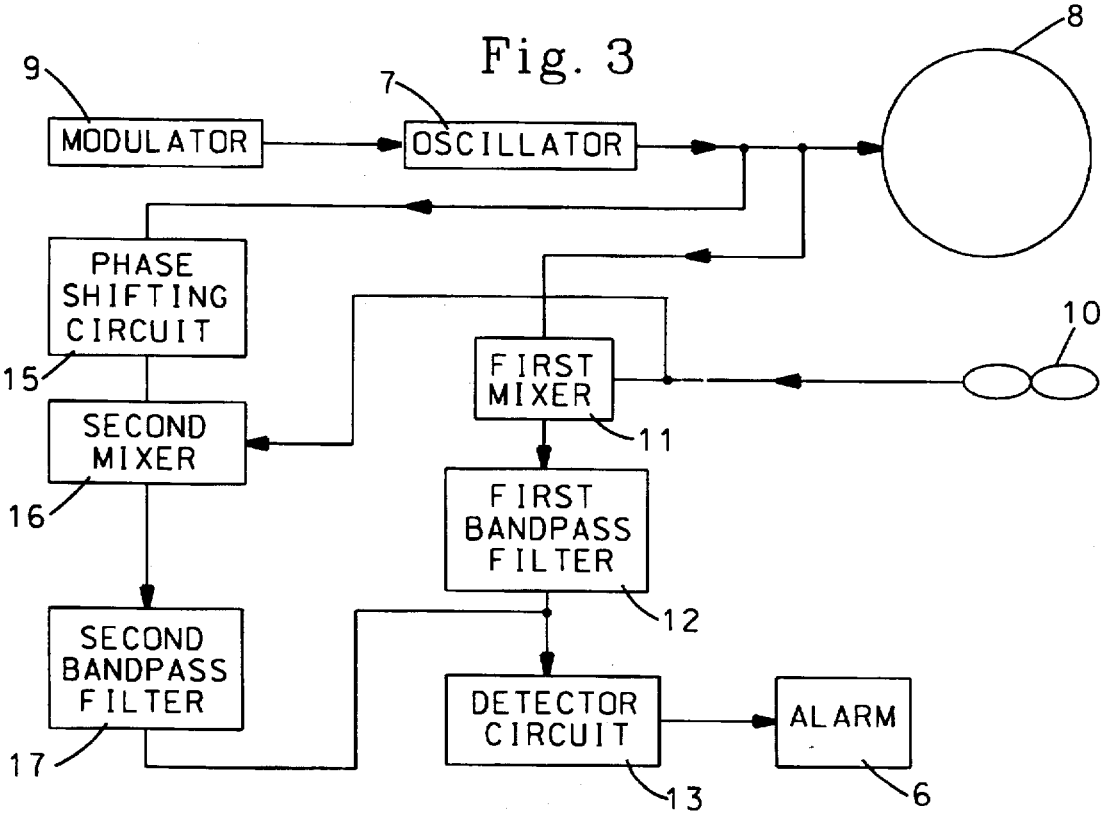
FIG. 3 is a block schematic illustrative of a receiver.

The schematic illustration of FIG. 1 includes a transmitter 2 and a receiver 3. The transmitter includes an oscillator 7 which supplies a transmitter antenna 8, see FIG. 3. In the case of the aforesaid embodiment, the signal generated by the oscillator can be modulated before being transmitted. This is effected by means of a modulator 9 intended for this purpose. The receiver 3 receives a signal from a receiver antenna 10. The receiver antenna is conveniently comprised of one or more tuned coils. The receiver 3 includes a first mixer 11 in which the received signal is mixed down with the transmitted signal.

Thus, there is used in the receiver a frequency mixture with the carrier wave frequency, which is a normal method of detecting amplitude modulated signals.

D.C. voltage and high frequency signals are taken out downstream of the mixer 11 with the aid of a first bandpass filter 12. This leaves a detected signal having the configuration illustrated in FIG. 4.

In order to obtain a signal which is not phase-dependent, there is provided parallel with the first mixer 11 and the first bandpass filter 12 a phase-shifting circuit 15 which shifts the transmitted signal through 90°. This signal is applied to a second mixer 16 in which the received signal is mixed down. The down mixed signal is filtered in a second bandpass filter 17 and the filtered signal is sent to a detector circuit 13. The signal obtained from the first bandpass filter is also sent to the detector circuit. The detector circuit 13 is constructed to select from the two signals arriving from the bandpass filters that signal which has the highest detection amplitude.

Figure 4:
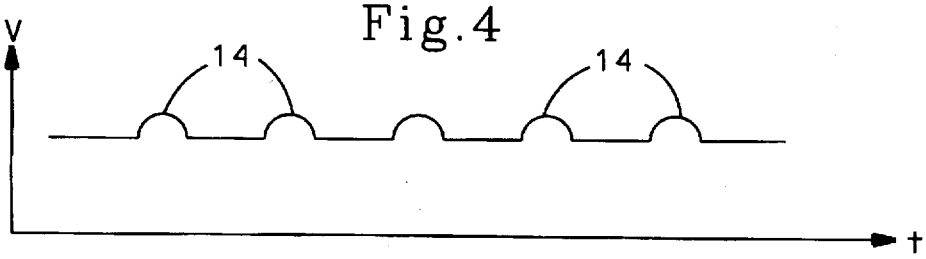
FIG. 4 illustrates schematically a received and detected signal.

The pulses 14 form a pulse train that has a frequency which is characteristic of the alarm plate or tag, namely the frequency with which the aforesaid process is repeated. In the case of the illustrated embodiment, the process is repeated at the frequency of 2 kHz. In FIG. 4, the reference sign V indicates voltage, i.e. amplitude, and t indicates time. This signal thus occurs downstream of the bandpass filter.

According to one simple embodiment, the detector circuit 13 may be located downstream of the bandpass filter, which is given a narrow band in this case. The detector circuit will only detect the occurrence of a signal which derives from the pulse train, wherein the occurrence of a pulse train signifies that an alarm element 1 is considered to be located in the investigation zone. The detector circuit will then deliver a signal to the alarm indicating device 6.

In the case of a more advanced embodiment, the detection circuit 13 is constructed to detect the pulse repetition frequency and/or pulse form of the pulse train and to decide on the basis thereof whether an alarm should be indicated or not. In this case, the detection circuit may comprise a microprocessor which is programmed to determine the pulse repetition frequency and/or to analyze the form of the pulses and to compare the pulse repetition frequency with a predetermined frequency and/or the form of the pulses with a predetermined form.

This embodiment is very secure against giving a false alarm, since it is not only the occurrence of an amplitude variation in the form of a pulse train that is detected, but that all pulse trains having a wrong pulse repetition frequency and/or pulse form, which can be due to disturbances, are sorted out.

A number of exemplifying embodiments have been described in the aforegoing. It will be understood, however, that the embodiments can be modified. For instance, the receiver and the transmitter may be of a different construction. Furthermore, the components of the alarm element may have other magnitudes than those mentioned.

The present invention is therefore not restricted to the aforedescribed and illustrated embodiments, since variations can be made within the scope of the following claims.

What is claimed is:

1. An alarm system including an alarm element for receiving a magnetic alternating field having a predetermined frequency and transmitted by a transmitter, wherein the alarm element retransmits a magnetic alternating field without an energy addition, and wherein the retransmitted alternating field is received and detected by a receiver in the alarm system, said alarm system comprising: an alarm element having a circuit which includes a coil, and a diode, wherein the diode is a capacitance diode which is connected in series with the coil and in series with a resistor in a closed circuit, and a capacitor connected in parallel across the resistor; wherein the coil and the capacitance diode define a resonance circuit which has resonance at the predetermined frequency when the voltage across the diode is zero volts; and wherein the resonance circuit provides periodic resonance variations that are detected by the receiver.

2. An alarm system in accordance with claim 1, wherein the capacitance of the capacitor is greater than the capacitance of the capacitance diode.

3. An alarm system in accordance with claim 2, wherein the resistance of the resistor and the capacitance of the capacitor provide a time constant for discharge of the capacitor of about 0.1 to about 5 milliseconds.

4. An alarm system in accordance with claim 1, wherein the transmitter transmits a frequency modulated field at a predetermined frequency between about 1.5 MHz and about 15 MHz, wherein a modulation frequency is from about 20 to about 200 Hz and has a frequency swing for reducing the requisite tolerance of components of the alarm element for suppression of disturbances.

5. An alarm system in accordance with claim 4, wherein the frequency swing exceeds +/− 2% but is less than 10% of the predetermined frequency.

6. An alarm system in accordance with claim 1, wherein the predetermined frequency lies in a range of from about 5 kHz to about 500 kHz, and wherein the transmitter transmits a frequency modulated field wherein the modulation frequency is stochastic.

7. An alarm system in accordance with claim 1, wherein the transmitter transmits a magnetic alternating field only when the predetermined frequency is rising in response to the modulation frequency and does not transmit when the predetermined frequency is falling.

8. An alarm system in accordance with claim 1, wherein the magnetic alternating field retransmitted by the alarm element includes a pulse train having a pulse repetition frequency, wherein the receiver includes a detection circuit for detecting the alarm element pulse repetition frequency and for comparing the alarm element pulse repetition frequency with a predetermined pulse repetition frequency to deliver a signal to an alarm indicating device when agreement is found between the alarm element pulse repetition frequency and the predetermined pulse repetition frequency.

9. An alarm system in accordance with claim 4, wherein the frequency swing is within about +/− 5% of the predetermined frequency.

* * * * *